United States Patent [19]

Niwa

[11] 4,383,158

[45] May 10, 1983

[54] COOKING OVEN WITH MULTI-FUNCTION GAS SENSOR

[75] Inventor: Takeshi Niwa, Nara, Japan

[73] Assignee: Matsushita Electric Industrial Co., Ltd., Osaka, Japan

[21] Appl. No.: 217,405

[22] Filed: Dec. 17, 1980

[30] Foreign Application Priority Data

Dec. 24, 1979 [JP] Japan ..... 54-168851

[51] Int. Cl.[3] ..... H05B 6/68

[52] U.S. Cl. ..... 219/10.55 B; 219/10.55 R; 73/73; 99/DIG. 14

[58] Field of Search ..... 219/10.55 B, 10.55 R, 219/10.55 M, 10.55 A; 324/65 A; 73/73, 75, 362.8; 99/325, 451, DIG. 14

[56] References Cited

U.S. PATENT DOCUMENTS 4,080,564 3/1978 Nitta et al. ..... 219/10.55 B 4,097,707 6/1978 Kobayashi et al. ..... 219/10.55 B

*Primary Examiner*—B. A. Reynolds

*Assistant Examiner*—Philip H. Leung

*Attorney, Agent, or Firm*—Spencer & Kaye

[57] ABSTRACT

A cooking oven in which a ceramic gas sensor is disposed in an exhaust guide which guides air from within the oven chamber toward the exterior of the oven casing. The surface temperature of the ceramic gas sensor is changed to change the sensing characteristic of the sensor, so that the single sensor can sense both water vapor and soot given off from food being cooked. A voltage source including a stabilized direct current voltage source and a non-stabilized or alternating current voltage source is provided for supplying power to the ceramic gas sensor. In the soot sensing mode, the surface of the ceramic gas sensor is heated by the power supplied from the stabilized direct current voltage source to stabilize the soot sensing characteristic of the sensor. An electronic circuit controlling the cooking operation includes a plurality of amplifiers having different gains which are suitably selected to deal with the humidity sensing mode and the soot sensing mode.

5 Claims, 23 Drawing Figures

1
45
FM
46
44
48
11

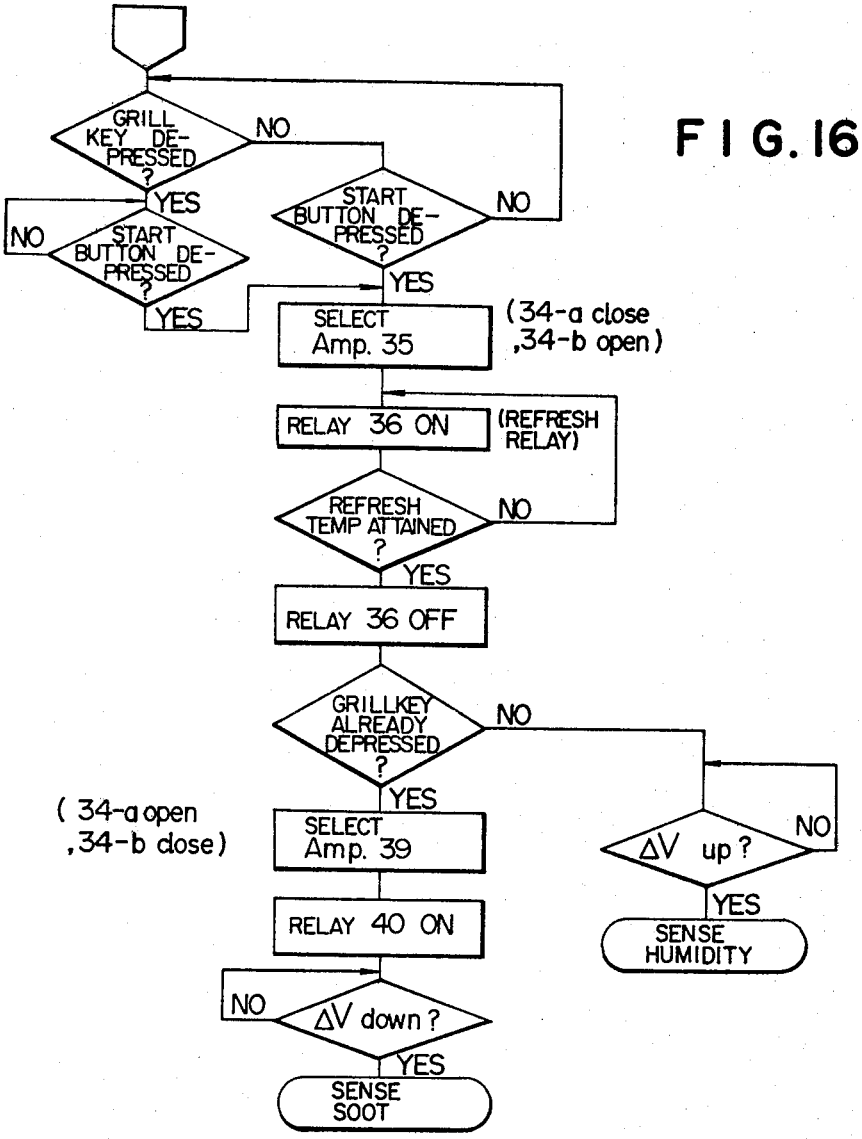
FIG. 16
FIG. 17
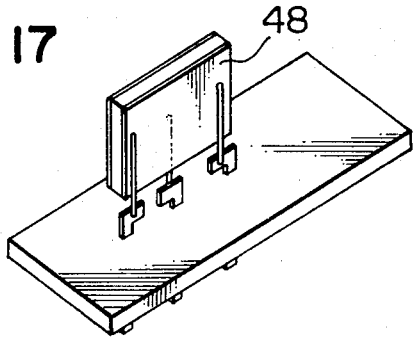

COOKING OVEN WITH MULTI-FUNCTION GAS SENSOR

This invention relates to a cooking oven having a microwave generator and a heater.

With the progress of the technology of transducer elements or so-called sensors used for transducing temperature, humidity and other information into corresponding electrical signals and also with the progress of the microcomputer technology, great progress has also been made in the field of cooking apparatus. An automatic microwave oven has been put into practical use in which, after the user puts materials to be cooked in the oven chamber and merely orders the start of the required cooking operation, a sensor installed in the microwave oven senses a change in the relative humidity of the air in the oven chamber due to vapor given off from the foodstuff. A microcomputer then processes the data and generates a command signal instructing the cooking operation to end or the output level of the microwave power required for cooking to change. However, in spite of the fact that a variety of components including very small amounts of vapor, soot and volatile matter must be sensed for the attainment of successful cooking, the unifunctional sensor employed in the prior art automatic microwave oven above described has not been capable of sensing components such as soot and volatile matter in very small amounts.

It is an object of the present invention to realize an automatic microwave oven having a heater function and provided with a multi-functional gas sensor which can singly sense both humidity and soot given off from a foodstuff.

It is another object of the present invention to provide a microwave oven including a foodstuff heater means and a microwave energy generating means, in which a ceramic gas sensor, whose sensing part is made of a ceramic composition and which is provided with a heater for heating the sensing part, is disposed in an exhaust guide. The temperature level of the heat applied to the sensing part of the sensor is varied by a control signal applied from an electronic circuit controlling the foodstuff heater means and microwave energy generating means thereby changing the sensing characteristic of the sensor. In this way the single sensor can sense both humidity and soot which are different from each other in character and are required as information for the achievement of successful cooking.

Another object of the present invention is to provide a microwave oven of the above character in which the sensing part of the sensor is heated at one of a plurality of temperature levels depending on the cooking information to be sensed by the sensor. That is, the sensing part is heated at a low temperature level to prevent dew being formed thereon when a change in the relative humidity of the air in the oven chamber due to vapor given off from a foodstuff is to be sensed, while it is heated up to a relatively high but stable temperature level when the soot given off from the foodstuff is to be sensed.

Still another object of the present invention is to provide a microwave oven of the above character, in which, in spite of the fact that the level of the sensor output signal during the soot sensing operation differs greatly from that of the sensor output signal during the humidity sensing operation, the electronic circuit can process the individual sensor output signals with substantially the same reliability.

The above and other objects, features and advantages of the present invention will become more apparent from the following detailed description taken in conjunction with the accompanying drawings, in which.

Figure 1:
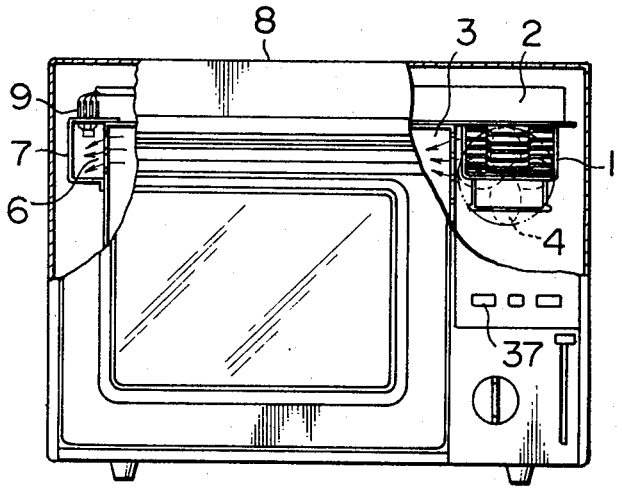
FIG. 1 is a partly cut-away front elevation view of an embodiment of the microwave oven provided with a ceramic gas sensor according to the present invention.
Figure 2:
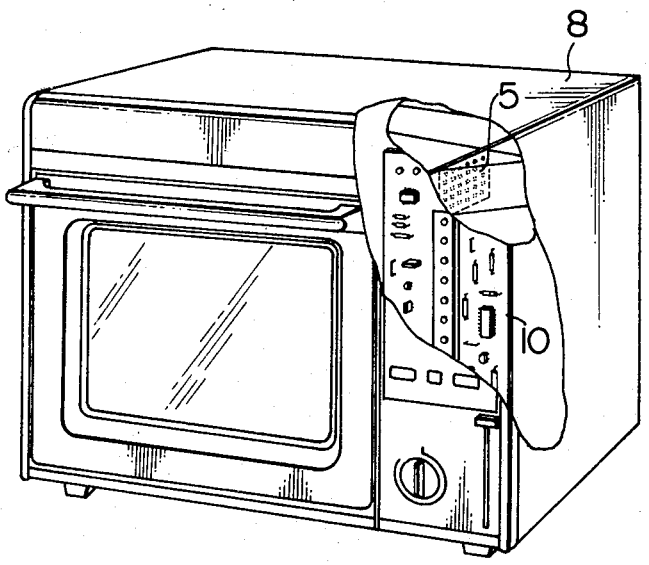
FIG. 2 is a partly cut-away front perspective view of the microwave oven provided with the ceramic gas sensor according to the present invention.
Figure 3:
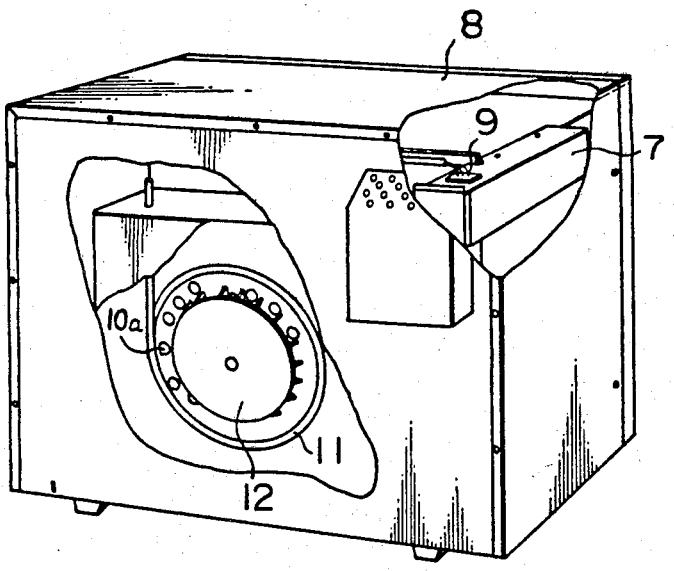
FIG. 3 is a partly cut-away rear perspective view of the microwave oven provided with the ceramic gas sensor according to the present invention.
Figure 4:
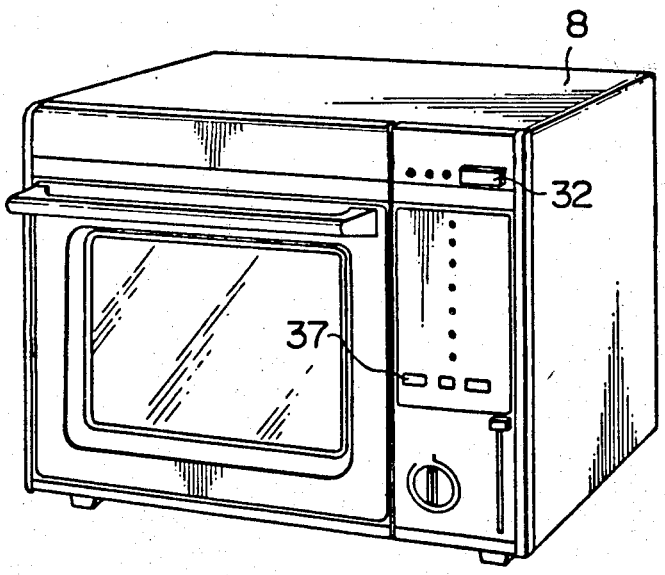
FIG. 4 is an external general view of the microwave oven provided with the ceramic gas sensor according to the present invention.

FIG. 16, which includes FIGS. 16A and 16B is a circuit diagram of the microwave oven control circuit including a microcomputer;

FIG. 17, which includes FIGS. 17A and 17B is a circuit diagram similar to FIG. 16 but including means for switching over the gain of the amplifiers;

FIG. 18 is a flow chart showing the steps of cooking carried out under control of the microwave oven control circuit; and FIG. 19 is a perspective view of a modification of the ceramic gas sensor in which the heater is replaced by one having a plane configuration.

Referring now to FIGS. 1 to 4, the microwave energy generated by a magnetron 1 is guided by a wave guide 2 to be directed toward and into an oven chamber 3 of a microwave oven and is absorbed by materials placed in the oven chamber 3 to be cooked by the microwave energy. An air stream produced by a cooling fan 4 provided for cooling the magnetron 1 passes through a punched portion 5 of one of the side walls of the oven chamber 3 to flow into the oven chamber 3.

Figure 5:
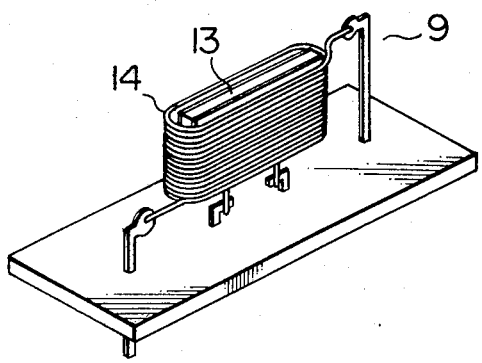
FIG. 5 is a perspective view of the ceramic gas sensor.

Then, the air stream passes through a punched portion 6 of the other side wall of the oven chamber 3 to flow out from the oven chamber 3 and is guided by an exhaust guide 7 to be discharged to the exterior of the casing 8 of the microwave oven. A sensor 9 as shown in FIG. 5 is installed in the exhaust guide 7, and its sensing part 13 is made of a ceramic composition. This sensor 9 will therefore be called a ceramic gas sensor hereinafter. An electronic circuit 10 is installed in the casing 8 of the microwave oven so as to control all of the functions of the microwave oven on the basis of cooking parameter information sensed by the ceramic gas sensor 9. A plurality of punchings 10*a* are provided in the rear wall of the oven chamber 3 so that heat generated by a heater element 11 can be transmitted into the oven chamber 3 through the punchings 10*a* by the rotation of a fan 12 which directs a stream of hot air.

Figure 6:
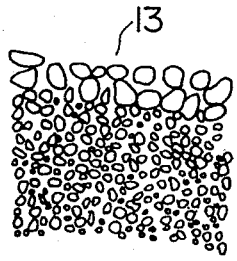
FIG. 6 is an enlarged detail view of the sensing part of the ceramic gas sensor shown in FIG. 5.

The sensing part 13 of the ceramic gas sensor 9, which is an important element of the microwave oven according to the present invention, is made of a metal-oxide ceramic composition having a porous structure as shown in FIG. 6. In the present invention, the fact that the electro-conductivity of a metal-oxide ceramic composition is variable depending on the amount of water adsorbed by a porous ceramics, is utilized to sense the relative humidity of the internal air in the microwave oven chamber 3 while cooking a foodstuff or by the soot given off from the foodstuff being cooked. The metal-oxide ceramic composition employed in the present invention is a sintered porous ceramic mixture of $MgCr_2O_4$ (magnesium chromate) and $TiO_2$ (titanium oxide). In the ceramic gas sensor 9, a heater 14 is associated with the sensing part 13 to apply heat to the sensing part 13 to burn out contaminants accumulating on or adhering to the surface of the sensing part 13 thereby keeping clean the surface of the sensing part 13, so that the ceramic gas heater 9 can fully exhibit its performance even under a severe operating condition in which it may be exposed to oil vapor and other organic vapor given off from a foodstuff being cooked or it may be subject to dewing during cooking.

Figure 7:
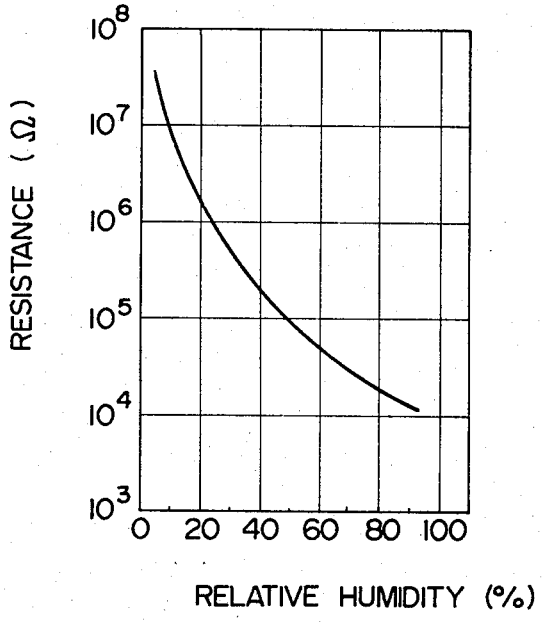
FIG. 7 is a graph showing the relative humidity vs. resistance characteristic of the ceramic gas sensor.
Figure 8:
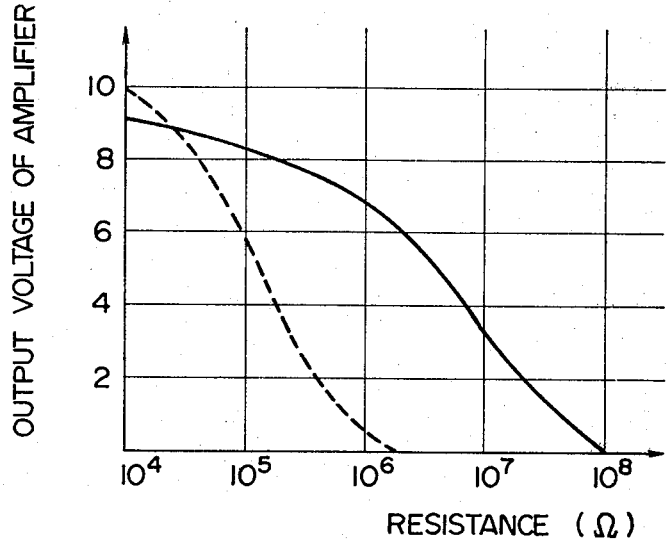
FIG. 8 is a graph showing the output voltage characteristic of the amplifiers relative to the resistance of the ceramic gas sensor.

This ceramic gas sensor 9 shows its sensitivity to a change in the relative humidity from 0% to 100% as shown in FIG. 7, and the resistance of its sensing part 13 changes over a considerably wide range of from about $10^8\ \Omega$ to about $10^4\ \Omega$ as shown by the curve in FIG. 7. Therefore, in order to convert the change of resistance over such a wide range into a corresponding change of output voltage, an amplifier providing such an output voltage which, in general, changes smoothly over the entire changeable resistance range as shown by the solid curve in FIG. 8, is essentially required. The dotted curve represents the soot sensing characteristic.

Figure 9:
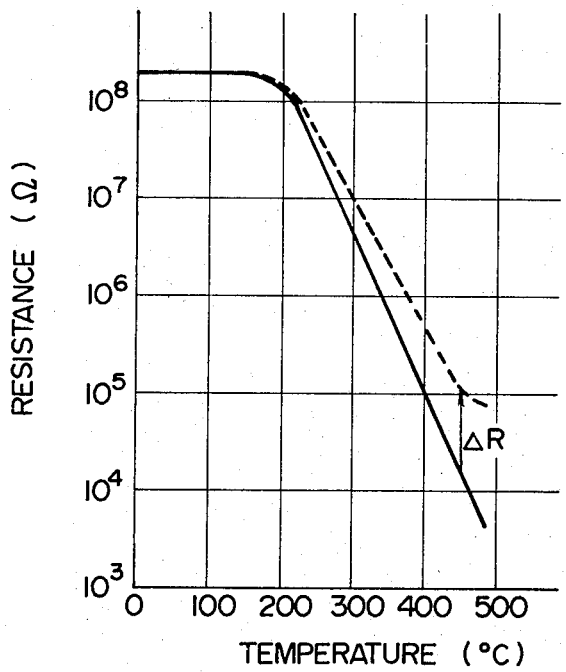
FIG. 9 is a graph showing the soot sensing characteristic of the ceramic gas sensor.

The dotted curve in FIG. 9 shows a resistance change in the sensing part 13 relative to the temperature when the ceramic gas sensor 9 is exposed to air containing soot. The solid curve in FIG. 9 represents the temperature vs. resistance characteristic of the ceramic gas sensor 9 when it is exposed to soot-free air. FIG. 9 shows that, when soot is present in the ambient air, the sensing part 13 of the ceramic gas sensor 9 senses very small amounts of volatile matter such as hydrocarbons and aldehydes contained in the soot, and the resistance of the sensing part 13 becomes higher than when such matter is not present. The higher the temperature, the greater the rate of change of the resistance of the sensing part 13. This rate $\Delta R$ of the change of the resistance of the sensing part 13 is such that the resistance value changes from about $10^4\ \Omega$ to about $10^5\ \Omega$ in the vicinity of 450° C. and is thus very small compared with that observed when the relative humidity of the air or the content of water vapor in the air changes from 0% to 100%. Therefore, another amplifier, which is used in the soot sensing operation, need not exhibit its amplification performance over a wide resistance range unlike that used in the humidity sensing operation. Rather it is required to provide a large gain in a resistance range of from about $10^4\ \Omega$ to about $10^6\ \Omega$. The level of the voltage applied across the heater 14 during the humidity sensing operation is also selected to differ from that applied acorss the heater 14 during the soot sensing operation. In the case of the humidity sensing operation, the level of the voltage applied across the heater 14 to heat the sensing part 13 is such that the temperature of the heated sensing part 13 is higher by about 5° C. than room temperature so that the sensing part 13 may not be subject to dewing thereby preventing or avoiding degradation of the humidity sensing characteristic. On the other hand, in the case of the soot sensing operation, it is necessary to heat the sensing part 13 up to about 450° C. at which the ceramic gas sensor 9 shows its high sensitivity to soot.

Figure 10:
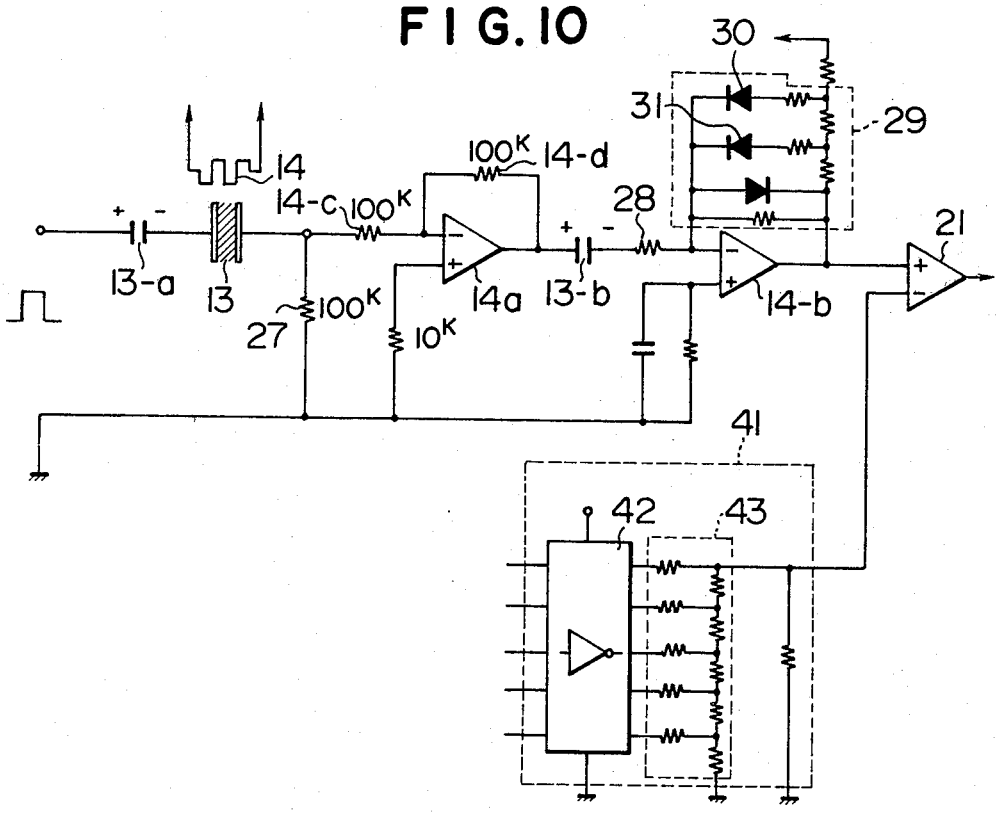
FIG. 10 is a sketch of the structure of the electronic circuit.

FIG. 10 is a sketch of the structure of the electronic circuit 10. The circuit 10 acts as a humidity sensing circuit when a switch 15 is switched to the position connecting the sensor 9 to an amplifier 16 participating in the humidity sensing operation, and another switch 17 is switched to the position connecting the heater 14 to a low-voltage source 18 which supplies power of low level consumed by the heater 14 to avoid dewing. On the other hand, the circuit 10 functions as a soot sensing circuit when the switch 15 is switched to the position connecting the sensor 9 to another amplifier 19 participating in the soot sensing operation, and the switch 17 is switched to the position connecting the heater 14 to a high-voltage source 20 which supplies power of high level consumed by the heater 14. The output voltage generated from each of these amplifiers 16 and 19 is compared in a comparator 21 with an output voltage generated from a reference voltage generator 22, and the resultant output voltage appears from the comparator 21. On the basis of the relation between the reference voltage and the output voltage of the comparator 21, the present level of the output voltage or the resistance value of the sensing part 13 of the ceramic gas sensor 9 can be detected.

Figure 11:
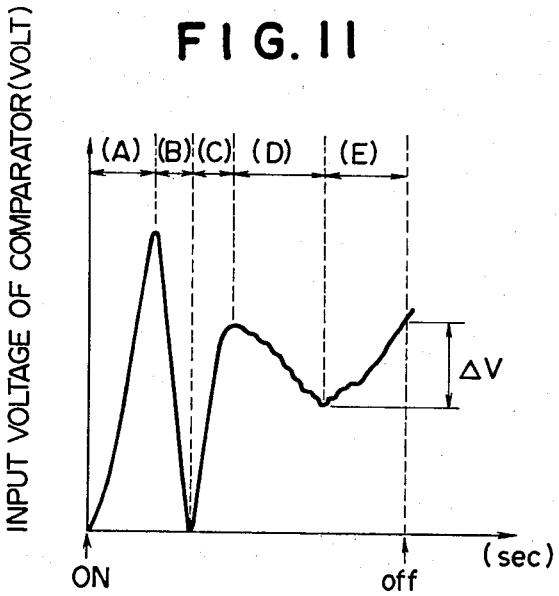
FIG. 11 is a circuit diagram showing the structure of the voltage source supplying power to the heater heating the surface of the ceramic gas sensor.

FIG. 11 is a circuit diagram of the voltage source for the heater 14. When a switch 23 is switched to the position N.O. and another switch 24 is closed, the secondary voltage of a transformer 25 is applied across the heater 14, and the heater 14 heats the sensing part 13 of the ceramic gas sensor 9 up to a temperature higher than about 500° C. to burn out contaminants such as oil vapor and dust accumulating on or adhering to the surface of the sensing part 13. This is the so-called refreshing operation which is necessarily carried out prior to cooking so as to prevent or avoid degradation of the sensitivity of the sensor 9. On the other hand, when the switch 24 is opened with the switch 23 maintained in the position N.O., the voltage obtained by dividing the secondary voltage of the transformer 25 by a resistor 26 and the resistance of the heater 14 is applied across the heater 14, and the heater 14 warms up the sensing part 13 of the ceramic gas sensor 9 to avoid dewing on the sensor 9 making the humidity sensing operation. When the switch 23 is then switched to the position N.C., the secondary AC voltage of the transformer 25 is applied across the heater 14 after being converted into a stabilized direct current voltage by a stabilized direct current voltage supply circuit 25-*a*, and the heater 14 heats the sensing part 13 of the ceramic gas sensor 9 up to about 450° C. Such a power supply system is thus effective in stabilizing the soot sensing characteristic of the ceramic gas sensor 9 regardless of variations of the power supply voltage.

Figure 12:
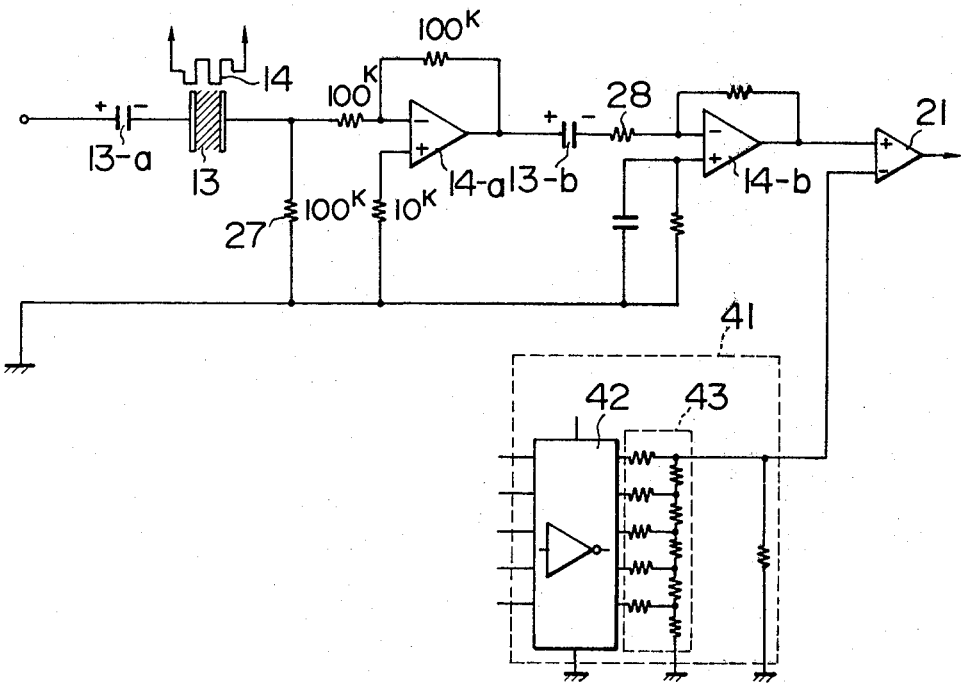
FIG. 12 is a circuit diagram of the electronic circuit when the ceramic gas sensor is operating as a humidity sensing device.

FIG. 12 is a circuit diagram of the electronic circuit 10 when the ceramic gas sensor 9 is making the humidity sensing operation. The circuit includes capacitors 13-*a* and 13-*b* which are provided so that direct current components, which may be superposed on the pulse input or signal and applied to the sensing part 13 of the ceramic gas sensor 9, may not cause electrolysis of the metal-oxide ceramic composition resulting in degradation of the sensitivity of the sensor 9. The signal voltage divided by the resistance of the sensing part 13 and a resistor 27 is applied to a first operational amplifier 14-*a* in which the signal voltage is amplified by the factor determined by the ratio between the resistance values of resistors 14-*c* and 14-*d* and has its phase inverted. The output voltage of the first operational amplifier 14-*a* is then amplified by a second operational amplifier 14-*b* by the factor determined by the ratio between the resistance values of a resistor 28 and a feedback resistor group 29 and has its phase similarly inverted. The resultant output voltage of the second operational amplifier 14-*b* is applied as an input to the comparator 21. Thus, the signal voltage is applied as one of the inputs to the comparator 21 after being subjected to the two-stage inverting amplification. Diodes 30 and 31 are connected in series with the associated resistors respectively in the feedback resistor group 29 to function as switching diodes. These switching diodes act to suitably change over the resistance of the feedback resistor group 29 depending on the level of the amplifier output voltage so that the amplifier output voltage can make a generally smooth change during a change of the resistance of the sensing part 13 of the ceramic gas sensor 9 between about $10^4$ Ω and about $10^8$ Ω.

Figure 13:
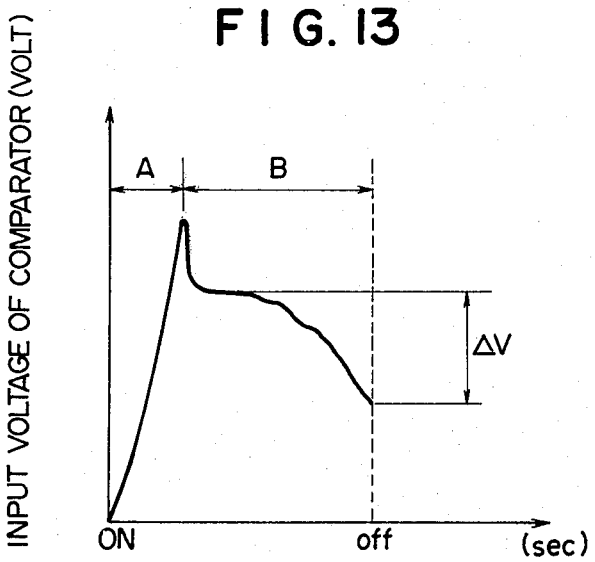
FIG. 13 is a graph showing the time-depending change of the comparator input voltage when the ceramic gas sensor is operating as a humidity sensing device.

FIG. 13 shows the time-depending change of the input voltage applied to the comparator 21. In the range (A), the comparator input voltage increases due to the fact that the temperature of the sensing part 13 rises owing to the refreshing operation and the resistance value of the sensing part 13 becomes small. Upon attainment of the cleaning temperature, the voltage source for the heater 14 is switched over so that it serves the dewing preventive function. Thus, in the range (B), the resistance value of the sensing part 13 becomes large and the comparator input voltage decreases. In the range (C), the sensing part 13 is sufficiently cooled by the air stream to show the humidity sensing characteristic, and the comparator input voltage increases again. Cooking is continued in such a condition resulting in a rise of the temperature of the air in the oven chamber 3 and in a decrease of the relative humidity of the air in the oven chamber. Thus, in the range (D), the resistance value of the sensing part 13 of the ceramic gas sensor 9 becomes gradually large, and the comparator input voltage decreases gradually. Then, when water vapor begins to be given off from materials being cooked, the relative humidity of air in the oven chamber 3 increases rapidly, and the resistance value of the sensing part 13 of the ceramic gas sensor 9 begins to become small. Thus, in the range (E), the comparator input voltage starts to increase again. The increment ΔV of the comparator input voltage from its lowest level in the range (E) is detected so as to control the cooking operation.

Figures 14, 14A, 14B:
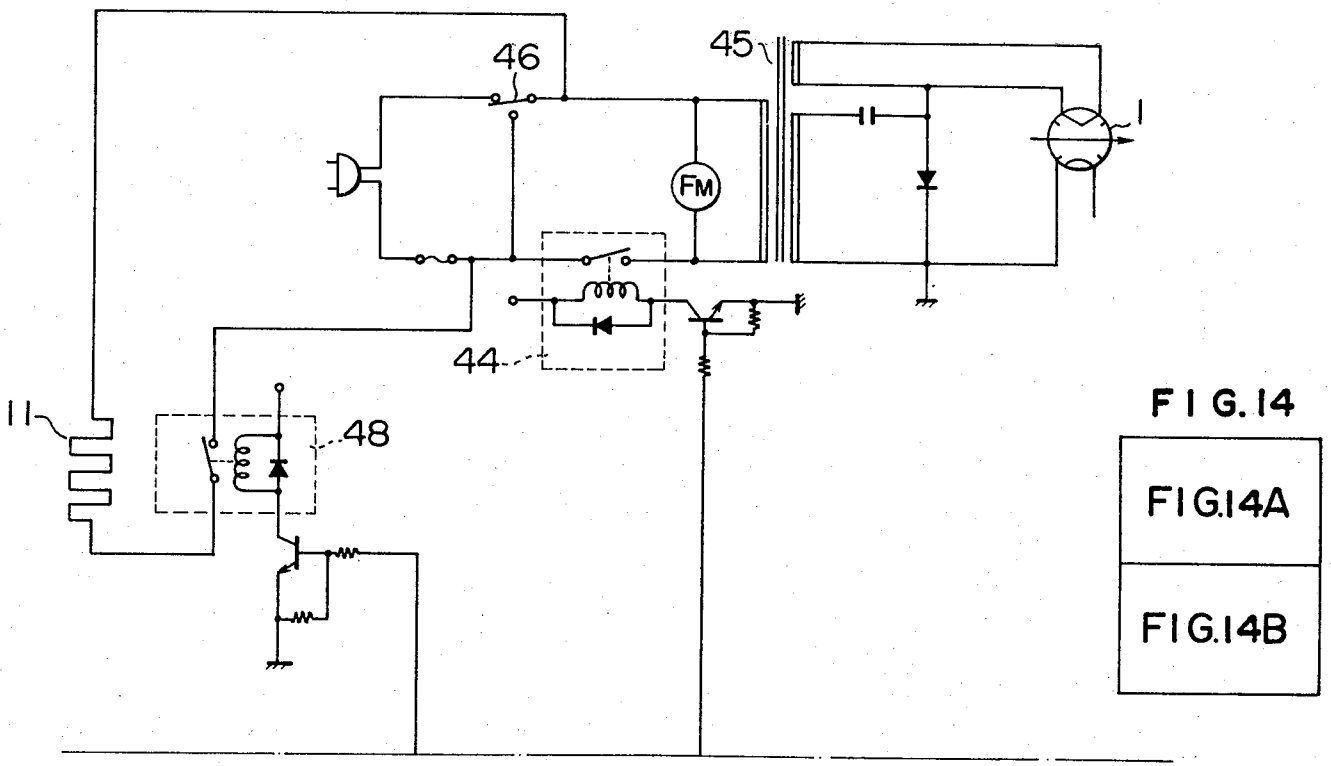
FIG. 14 is a circuit diagram of the electronic circuit when the ceramic gas sensor is operating as a soot sensing device.
Figure 14B:
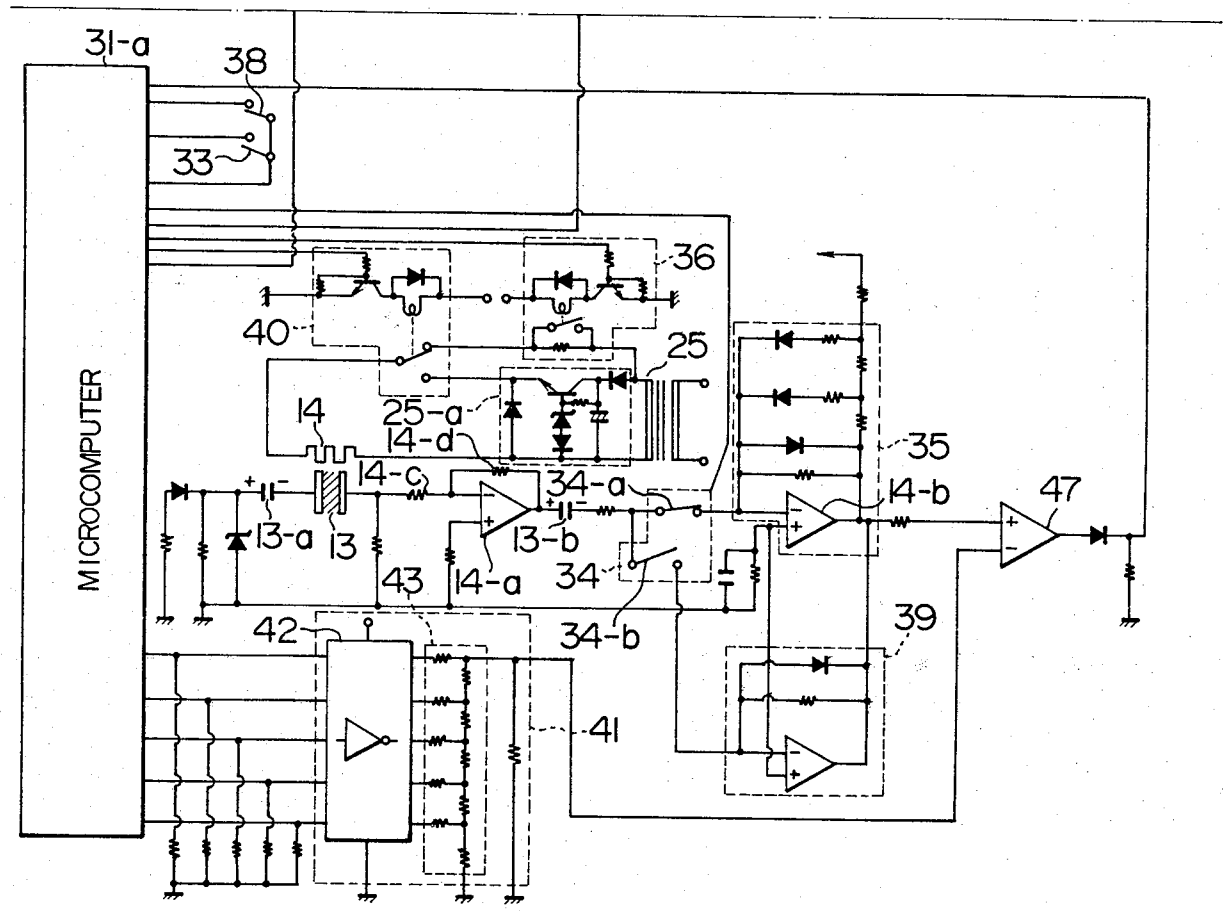

FIG. 14 is a circuit diagram of the electronic circuit 10 when the ceramic gas sensor 9 is making the soot sensing operation. The amplification characteristic of the amplifiers in this circuit is as represented by the dotted curve in FIG. 8.

Figure 15A:
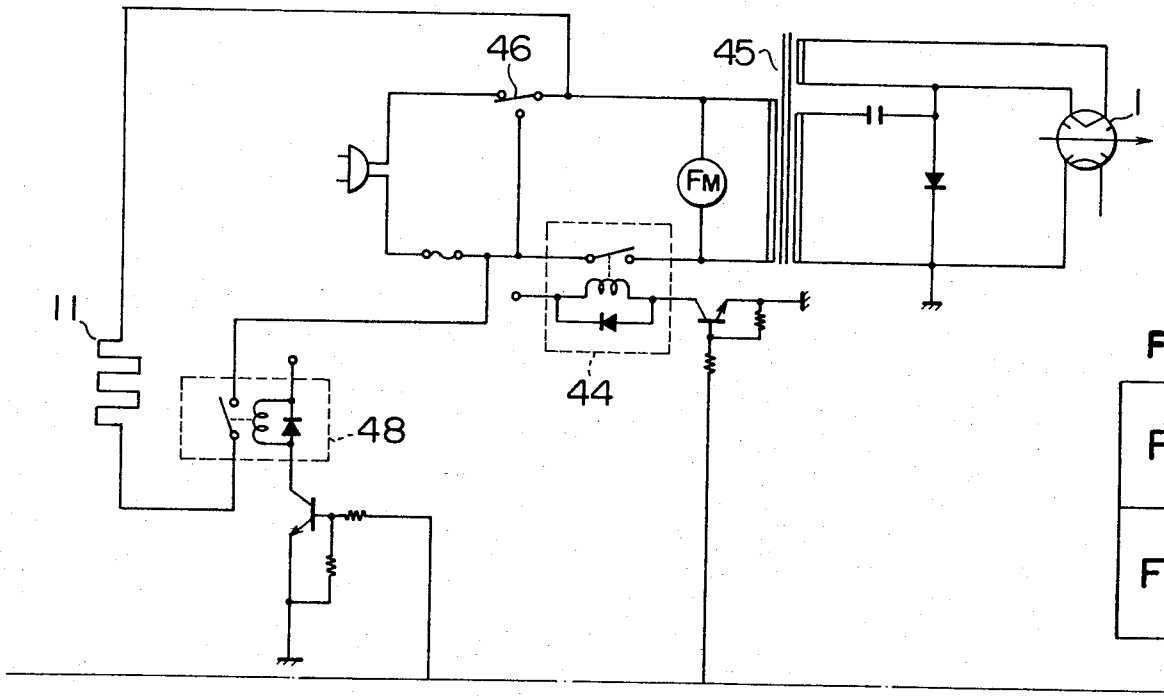
FIG. 15 is a graph showing the time-depending change of the comparator input voltage when the ceramic gas sensor is operating as a soot sensing device.
Figure 15:
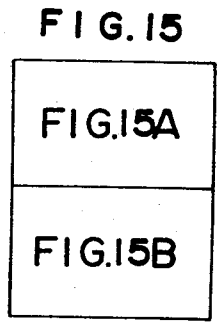
Figure 15B:
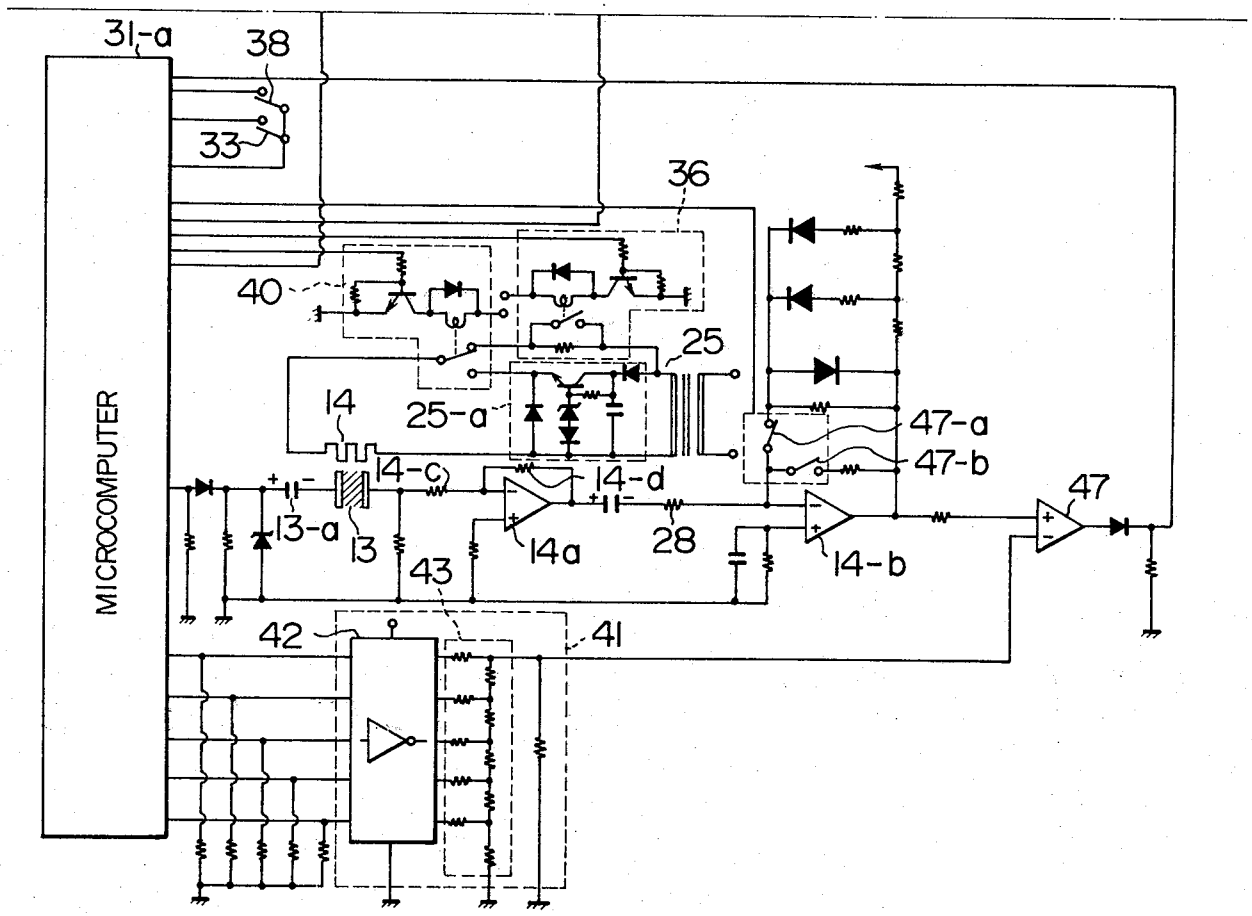

FIG. 15 shows the time-depending change of the comparator input voltage when the ceramic gas sensor 9 is making the soot sensing operation. In the range (A) in FIG. 15, the comparator input voltage increases because of the refreshing operation. Upon complete burnout of contaminants accumulating on or adhering to the surface of the sensing part 13 of the ceramic gas sensor 9, the voltage source for the heater 14 is switched over to carry out the heating function for heating the sensing part 13 up to about 450° C. The resistance value of the sensing part 13 becomes gradually large as the ceramic gas sensor 9 is exposed to soot containing volatile matter such as hydrocarbons and aldehydes. Thus, in the range (B), the comparator input voltage starts to decrease. It is the detection level at which the voltage level is lowered by the decrement ΔV from that applied to the heater 14 to start heating of the sensing part 13 up to about 450° C.

FIG. 16, consisting of FIGS. 16A and 16B, is a circuit diagram of one form of the microwave oven control circuit including a microcomputer 31-*a* as a control means. Upon depression of a start button 32 (FIG. 4), a start switch 33 is closed to close a contact 34-*a* and open a contact 34-*b* of a semiconductor switch 34, and an amplifier 35 for the humidity sensing purpose is selected, while, at the same time, a refreshing operation relay 36 is energized. Upon attainment of the refreshing temperature, the refreshing operation relay 36 is deenergized to change over the voltage applied across the heater 14. When, on the other hand, the start button 32 is depressed after depression of a grill key 37 (FIG. 4), a grill switch 38 is turned on to open the contact 34-*a* and close the contact 34-*b* of the semiconductor switch 34 after the refreshing operation. An amplifier 39 for the soot sensing purpose is now selected, and a heating relay 40 is energized to change over the voltage applied acorss the heater 14. A D-A converter 41 includes a C-MOS IC 42 and a ladder type resistance network 43 connected to five output terminals of the IC 42, so that a 5-bit information output from the microcomputer 31-*a* can be converted into one of $2^5$ (=32) voltage levels. Further, depression of the start button 32 energizes the coil of a relay 44. Therefore, when a door switch 46 of the microwave oven is in its closed position, the power supply voltage is applied across the primary side of a high-voltage transformer 45 to induce a high voltage in the secondary side of the transformer 45 thereby causing oscillation of the magnetron 1. The microcomputer 31-*a* detects or calculates ΔV in FIG. 13 on the basis of the information including the output voltage of a comparator 47 and the reference voltage applied to the comparator 47 and fimally deenergizes the relay 44 to end the cooking operation.

When the start button 32 is depressed after depression of the grill key 37, the coil of a relay 48 is energized to energize the heater 11 disposed outside of the oven chamber 3. The microcomputer 31-*a* detects or calculates ΔV in FIG. 15 on the basis of the information including the output voltage of the comparator 47 and the reference voltage applied to the comparator 47 and finally deenergizes the relay 48 to end the cooking operation.

FIG. 17 shows a partial modification of the circuit shown in FIG. 16. In this modification, a pair of switches 47-*a* and 47-*b* are provided for switching over the resistors in the feedback resistance group 29 associated with the operational amplifier 14-*b*. The operational amplifier 14-*b* functions as a humidity sensing purpose amplifier when the switch 47-*a* is closed and the switch 47-*b* is opened, and as a soot sensing purpose amplifier when the switch 47-*a* is opened and the switch 47-*b* is closed. FIG. 18 is a flow chart showing the aforementioned steps of cooking carried out under control of the microcomputer 31-*a*.

FIG. 19 shows a modification of the ceramic gas sensor 9 shown in FIG. 5. in FIG. 19, the coil heater 14 is replaced by a heater 48 having a place configuration and such a plane heater 48 is mounted on the surface of the sensing part 13 of the ceramic gas sensor 9.

It will be understood from the foregoing detailed description that the present invention comprises a ceramic gas sensor, means for changing the level of heat applied to the sensing part of the ceramic gas sensor, and amplifiers having different gains. According to the present invention, the single sensor can sense both of a change in the relative humidity air in the oven chamber due to vapor given off from materials being cooked and volatile matters contained in soot given off from the materials being cooked. The present invention is therefore advantageous in that the state of cooking a "grill menu", which could not be sensed by resorting only to the humidity sensing characteristic of a prior art unifunctional gas sensor, can be automatically sensed so that the microwave oven can be used for the cooking of a variety of menus.

What is claimed is:

1. A cooking oven comprising a casing;

an oven chamber located within said casing for accommodating food to be cooked, said oven chamber having walls with entrance and exit openings located therein;

a microwave generator, microwave energy from said generator being guided into said oven chamber;

a heater element adjacent the walls of said oven chamber for heating the food placed in said oven chamber;

means for introducing ventilating air into said oven chamber through said entrance openings and ejecting air from said oven chamber through said exit openings;

a ceramic gas sensor positioned in the path of said ventilating air;

a heater member for heating the surface of said gas sensor to first and second temperature levels, said gas sensor being capable of sensing a first gas within said oven chamber at said first temperature of the surface of said gas sensor and being capable of sensing a second gas within said oven chamber at said second temperature of the surface of said gas sensor, said second gas being different from said first gas;

a control circuit for selectively controlling the operation of said microwave generator and said heater element in response to an output signal from said ceramic gas sensor and for controlling switching of the heating temperature levels of said heater member in accordance with whether said first or second gas is to be sensed; and switching means for controlling said heater member to change the surface temperature of said ceramic gas sensor in response to a control signal applied from said control circuit.

2. A microwave oven as claimed in claim 1, wherein said heater member for heating the surface of said ceramic gas sensor is connected to power source means including a stabilized direct current power source and an alternating current power source, said direct current and alternating power sources being selectively switched across said heater member by said switching means.

3. A microwave oven as claimed in claim 1, wherein said control circuit includes a plurality of amplifiers having different gains for amplifying the output signal from said ceramic gas sensor.

4. A cooking oven comprising:

an oven chamber for accommodating a food item to be cooked;

a microwave generator for supplying microwave energy into said oven chamber;

an electrical food-heater for heating the food item to be cooked;

an air guide for guiding air within said oven chamber towards the exterior of said oven chamber;

a single ceramic gas sensor disposed in said air guide, said single gas sensor being capable of sensing the relative humidity of the air within said oven chamber at a first temperature of the surface of said single ceramic gas sensor and being capable of sensing soot liberated from the food item at a second temperature of the surface of said single ceramic gas sensor;

an electrical sensor-heater located adjacent but spaced from the surface of said single ceramic gas sensor for heating the surface thereof to selectively maintain the surface temperature of said ceramic gas sensor at said first temperature or at said second temperature;

cooking mode selection means for selecting one of first and second cooking modes; and a control circuit connected to receive output signals from said single ceramic gas sensor and said cooking mode selecting means, said control circuit controlling the heating of the food item by said microwave generator or said electrical food-heater;

upon selection of said first cooking mode, said microwave generator and said electrical sensor-heater being energized so that said electrical sensor-heater maintains the surface temperature of said single ceramic gas sensor at said first temperature to render said single ceramic gas sensor sensitive to the relative humidity within said oven chamber thereby effecting control of the heating by said microwave generator in accordance with a change in the relative humidity; and upon selection of said second cooking mode, said electrical food-heater and said electrical sensor-heater being energized so that said electrical sensor-heater maintains the surface temperature of said single ceramic gas sensor at said second temperature to render said single ceramic gas sensor sensitive to the soot within said oven chamber thereby effecting control of the heating by said electrical food-heater in accordance with a change in the amount of soot.

5. A cooking oven according to claim 4 wherein said first temperature of the surface of said single ceramic gas sensor corresponds to a temperature at which the surface of said gas sensor is prevented from forming dew; and said second temperature corresponds to a temperature of about 450° C.

* * * * *

UNITED STATES PATENT AND TRADEMARK OFFICE

CERTIFICATE OF CORRECTION

PATENT NO. : 4,383,158

DATED : May 10th, 1983

INVENTOR(S) : Takashi Niwa

It is certified that error appears in the above—identified patent and that said Letters Patent is hereby corrected as shown below:

In the heading of the patent, under [75] Inventor, the inventor's first name is misspelled, instead of "Takeshi" it should read --Takashi--.

Renumber drawing figures 10, 11, 12, 13, 14A, 14B, 15A, 15B, 16 and 17 to read --12, 13, 14, 15, 16A, 16B, 17A, 17B, 18 and 19--.

Add Figures 10 and 11 as shown:

FIG. 10

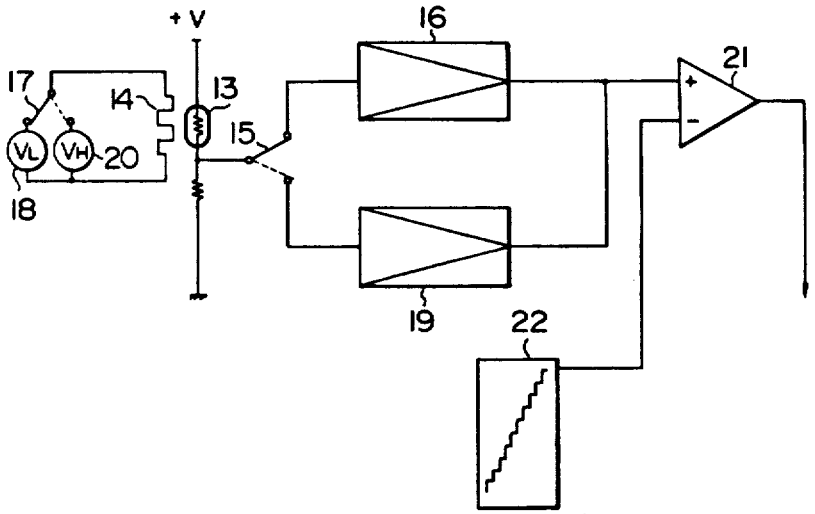

UNITED STATES PATENT AND TRADEMARK OFFICE

CERTIFICATE OF CORRECTION

PATENT NO. : 4,383,158

DATED : May 10th, 1983

INVENTOR(S) : Takashi Niwa

It is certified that error appears in the above—identified patent and that said Letters Patent is hereby corrected as shown below:

FIG. 11

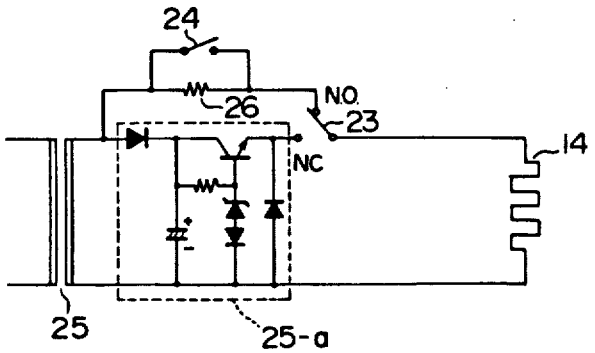

Signed and Sealed this

*Thirteenth* Day of *March 1984*

[SEAL]

*Attest:*

GERALD J. MOSSINGHOFF

*Attesting Officer*

*Commissioner of Patents and Trademarks*